US008646603B2

(12) United States Patent
Ramirez et al.

(10) Patent No.: US 8,646,603 B2
(45) Date of Patent: Feb. 11, 2014

(54) APPARATUS AND METHOD FOR ALIGNING AND HOLDING LIGHT BULBS

(75) Inventors: Richard L. Ramirez, Lawrenceville, GA (US); Mark A. Bergeron, Monroe, GA (US)

(73) Assignee: Tekni-Plex, Inc., King of Prussia, PA (US)

( * ) Notice: Subject to any disclaimer, the term of this patent is extended or adjusted under 35 U.S.C. 154(b) by 0 days.

(21) Appl. No.: 13/271,899

(22) Filed: Oct. 12, 2011

(65) Prior Publication Data

US 2013/0092585 A1 Apr. 18, 2013

(51) Int. Cl.
*B65D 85/42* (2006.01)
*B65D 81/133* (2006.01)

(52) U.S. Cl.
USPC ..... 206/419; 206/443; 206/589

(58) Field of Classification Search
USPC ..... 206/419, 418, 422, 420, 421, 391, 327, 206/443, 589, 585, 564; 220/508
See application file for complete search history.

(56) References Cited

U.S. PATENT DOCUMENTS

| | | | | | |
|---|---|---|---|---|---|
| 2,564,729 | A * | 8/1951 | Shepard | 206/419 |
| 2,568,769 | A * | 9/1951 | Shepard | 206/419 |
| 2,783,879 | A * | 3/1957 | Emery | 206/443 |
| 2,984,345 | A * | 5/1961 | Emery | 206/419 |
| 3,163,312 | A * | 12/1964 | Chaplin | 217/26.5 |
| 3,223,234 | A * | 12/1965 | Weiss | 206/419 |
| 3,708,084 | A * | 1/1973 | Bixler et al. | 217/26.5 |
| 4,101,049 | A * | 7/1978 | Wallace et al. | 206/521.1 |
| 4,375,262 | A * | 3/1983 | Hrenyo | 206/418 |
| 4,427,730 | A * | 1/1984 | Robbins et al. | 428/156 |
| 4,705,170 | A * | 11/1987 | Creaden | 206/419 |
| 4,792,045 | A * | 12/1988 | Creaden | 206/419 |
| 4,936,450 | A * | 6/1990 | Paul | 206/386 |
| 4,936,453 | A * | 6/1990 | Knitter | 206/419 |
| 4,942,965 | A * | 7/1990 | Comer | 206/419 |
| 5,016,751 | A * | 5/1991 | Creaden | 206/419 |
| 5,058,744 | A * | 10/1991 | Creaden | 206/419 |
| 5,499,716 | A * | 3/1996 | Gardner | 206/553 |
| 6,142,440 | A * | 11/2000 | Gratz et al. | 248/346.01 |
| 6,705,469 | B2 * | 3/2004 | Slot | 206/587 |
| 7,237,675 | B2 * | 7/2007 | O'Malley | 206/433 |
| 2003/0070951 | A1 * | 4/2003 | Hurley et al. | 206/427 |
| 2010/0243512 | A1 * | 9/2010 | Hardy | 206/563 |

* cited by examiner

*Primary Examiner* — Steven A. Reynolds
(74) *Attorney, Agent, or Firm* — Novak Druce Connolly Bove + Quigg LLP

(57) ABSTRACT

A mounting pad and method for mounting a plurality of light bulbs in a compact and shock resistant arrangement for storage in a box and for transport, the plurality of light bulbs being arranged in rows generally parallel to each other by mounting the terminal ends of a row of light bulbs in a mounting pad disposed at each terminal end of the bulbs and stacking successive rows of mounted bulbs one on top of each other.

21 Claims, 9 Drawing Sheets

APPARATUS AND METHOD FOR ALIGNING AND HOLDING LIGHT BULBS

FIELD OF THE INVENTION

The present invention relates to packing and more particularly to a tray or mounting pad having features that enable aligning and stacking of multiple bulbs within a confined space for transport.

BACKGROUND

Many factors are taken into consideration in the design of mounting pads, storage trays or receptacles that receive and mount fragile light bulbs for storage or transport. Where bulbs that are comprised of a breakable material such as glass formed into a cylindrical body shape are concerned, bulb protection, stackability, transportability, strength, weight, nestability/denestability, adaptability to accommodate bulbs of various cylindrical lengths and diameters, and consistent manufacturing are factors which may be considered to varying degrees in the design of a suitable tray or pad.

Polystyrene trays or pads can be formed and trimmed from a single sheet of polystyrene foam material to integrally define a tray. The formed trays are stacked one on top of each other in a nested fashion for purposes of being efficiently packaged and transported to a distributor who uses the trays to package light bulbs. The distributor fills the trays with bulbs that are formed as elongated cylindrical glass bodies with ends capped by cylindrical mounts that are typically comprised of a shatter or shock resistant plastic material. The filled trays are then stacked one on top of each other as stable and compact arrangement as possible whereby the stacked trays filled with bulbs can be snugly inserted within an elongated enclosed box having an interior configuration adapted to snugly receive and hold such compactly stacked trays such that the stacked and filled trays when inserted within the interior storage space of the box or container will not allow the trays to move around within or to fall out of the receiving box or container. Further they must now withstand transport to retail or other distribution points for storage display and sale. During all of these events it is desired to minimize breakage or damage to the bulbs, and to minimize the costs of assembly, packaging and transport.

SUMMARY OF THE INVENTION

The present invention provides a mounting pad for elongated light bulbs that are fragile and a method for aligning and stacking the mounting pads filled with light bulbs, one pair of filled pads on top of another, for stable packaging and transport without requiring the use of additional packaging.

The mounting pads may be made of a polymer foam, such as polystyrene foam, of dimensions and thickness that are selected to enable as compact a stacking of light bulbs as possible. The pads are typically molded or thermoformed and cut out of sheet of such polystyrene foam material. The thickness of the sheet foam material is typically less than about 1.5 mm and preferably less than about 1.3 millimeters.

In accordance with one embodiment of the invention, there is provided a mounting pad for receiving a plurality of light bulbs each having a preselected longitudinal bulb length, a longitudinal axis and a latitudinal bulb diameter, the mounting pad comprising:

a tray comprised of plastic material, the tray comprising a plurality of bulb mounting cells formed in an open top end of the tray, the cells having a longitude of selected cell length and a latitude of selected cell width, each cell adapted to receive a bulb with the bulb diameter extending across the selected width of a cell and with the longitudinal axis of the bulb aligned with the longitude of a cell;

the tray having a bottom end and a top to bottom axis generally normal to a bottom surface defined by a plurality of feet each having an undersurface extending downwardly to an axially bottom-most position lying in a generally common plane on the bottom end to define the bottom surface of the pad;

the bottom end having a generally flat lip disposed along a bottom latitudinal peripheral edge of the pad at about normal to the top to bottom axis, the flat lip projecting in a longitudinal direction away from the cells and having an undersurface disposed generally in the generally common plane; and the bottom end of the tray having another generally flat lip disposed along a bottom longitudinal peripheral edge of the tray, extending in a latitudinal direction away from the cells and having an undersurface disposed in the generally common plane.

The bottom end and the open top end of the pad typically have complementary male and female configurations respectively adapted to enable the bottom end of one tray to be stacked on top of, received and nested within the open top end of another tray.

The bottom end of the tray is preferably formed into a plurality of bottom facing recesses aligned with the longitude and latitude of the cells formed in the open top end, the bottom facing recesses being adapted to be stacked on top of, receive and mate with a plurality of bulbs mounted within the cells formed in the open top end of another tray.

The feet are typically formed by downwardly projecting ridges extending along lateral sides of the bottom facing recesses, the ridges having downwardly facing peak surfaces that lie generally within the generally common plane.

The selected cell length is preferably less than half the bulb length. With two pads, one on each end of the bulbs, the two pads together typically extend about 8 to about 50%, and in select embodiments from about 15% to about 40% of the bulb length. If desired, an additional pad could be used between the two end pads, e.g., for larger bulbs of for example 8 feet in length. The central pad would be shaped to support the circumference of the bulb, not the ends.

The tray typically comprises for example anywhere from 2 to 10 cells, typically 5 or 6 cells.

The tray is typically formed by a thermoforming process from a unitary sheet of the polymer material, e.g., foamed polystyrene.

The thickness of the formed tray is less than about 1.5 mm, typically less than about 1.3 mm.

In another aspect of the invention there is provided a mounting pad for receiving a plurality of light bulbs each having a preselected longitudinal bulb length, a longitudinal axis and a latitudinal bulb diameter, the mounting pad comprising:

a tray comprised of plastic material, the tray comprising a plurality of bulb mounting cells formed in an open top end of the tray, the cells having a longitude of selected cell length and a latitude of selected cell width, each cell adapted to receive a bulb with the bulb diameter extending across the selected width of a cell and with the longitudinal axis of the bulb aligned with the longitude of a cell;

the tray having a bottom end and a top to bottom axis generally normal to a bottom surface defined by a plurality of feet each having an undersurface extending downwardly to an axially bottom-most position lying in a generally common plane on the bottom end to define the bottom surface of the pad;

the bottom end having a generally flat lip disposed along a bottom longitudinal peripheral edge of the pad, extending in a latitudinal direction away from the cells and having an undersurface disposed in the generally common plane.

disposed at about normal to the top to bottom axis projecting in a latitudinal direction away from the cells along a bottom longitudinal peripheral edge of the pad, the lip having an undersurface disposed generally in the common plane.

In such an embodiment, the bottom end preferably has another generally flat lip disposed along a bottom latitudinal peripheral edge of the pad at about normal to the top to bottom axis and projecting in a longitudinal direction away from the cells and having an undersurface disposed generally in the generally common plane.

In another aspect of the invention there is provided a plurality of stacked light bulbs mounted in a spaced arrangement snugly fit within an enclosable box having a selected height, the box containing a plurality of mounting pads as previously described having a plurality of the light bulbs mounted within the cells of the trays of the pads, the plurality of pads with bulbs mounted in the trays of the pads being stacked one on top of each other in a number sufficient to extend the selected height of the box, the box having a length complementary to the bulb length together with any longitudinal length added to the bulb lengths when the bulbs are mounted in the cells of the trays of the pads, the box having a width complementary to the latitudinal width of the mounting pads.

In another aspect of the invention there is provided a plurality of stacked light bulbs mounted in a spaced arrangement snugly fit within an enclosable box having a selected height, the box containing a plurality of mounting pads as previously described having a plurality of the light bulbs mounted within the cells of the trays of the pads, the plurality of pads with bulbs mounted in the trays of the pads being stacked one on top of each other in a number sufficient to extend the selected height of the box, the box having a length complementary to the bulb length together with any longitudinal length added to the bulb lengths when the bulbs are mounted in the cells of the trays of the pads, the box having a width complementary to the latitudinal width of the mounting pads.

In another aspect of the invention there is provided a method of stacking light bulbs one on top of the other, each light bulb having a preselected longitudinal bulb length, a longitudinal axis and a latitudinal bulb diameter, the method comprising:

providing a mounting pad as previously described, inserting opposite longitudinal ends of a plurality of said light bulbs into the cells of the open top ends of the trays of corresponding pairs of said mounting pads, stacking one pair of mounting pads having light bulbs inserted in the cells of the trays of the mounting pads on top of another pair of mounting pads having light bulbs inserted in the cells of the trays of the other pair of mounting pads;

wherein the light bulbs inserted in the cells of the other pair are aligned with and received within the bottom facing recesses of the one pair of mounting pads stacked on top of the other pair, and, the longitudinal bulb lengths of the bulbs inserted within the one pair are aligned with the longitudinal bulb lengths of the other pair.

Such a method can further comprise:

providing a reversibly enclosable box having a selected height, a width complementary to the latitudinal width of the mounting pads and a length complementary to the longitudinal bulb length of the bulbs together with any longitudinal length added to the bulb lengths when the bulbs are mounted in the cells of the trays of the pads, inserting opposite longitudinal ends of a plurality of said light bulbs into the cells of the open top ends of the trays of successive pairs of said mounting pads and, stacking said successive pairs of mounting pads on top of each other to a height complementary to the selected height of the reversibly enclosable box, and, fully inserting the successively stacked mounting pads with bulbs inserted in the cell of the tray into the box such that the box fully encloses the inserted mounting pads and light bulbs.

In another aspect of the invention there is provided a mounting pad for receiving a plurality of light bulbs each having a preselected longitudinal bulb length, a longitudinal axis and a latitudinal bulb diameter, the mounting pad comprising:

a tray comprised of plastic material, the tray comprising a plurality of bulb mounting cells formed in an open top end of the tray, the cells having a longitude of selected cell length and a latitude of selected cell width, each cell adapted to receive a bulb with the bulb diameter extending across the selected width of a cell and with the longitudinal axis of the bulb aligned with the longitude of a cell;

the tray having a bottom end and a top to bottom axis generally normal to a bottom surface defined by a plurality of feet each having an undersurface extending downwardly to an axially bottom-most position lying in a generally common plane on the bottom end to define the bottom surface of the tray;

the bottom end having a generally flat lip disposed along a bottom longitudinal peripheral edge of the pad, extending in a latitudinal direction away from the cells and having an undersurface disposed generally in the generally common plane, wherein the tray includes walls extending from a top peripheral longitudinal edge to a bottom peripheral longitudinal edge of the tray at opposing latitudinal sides of the tray forming opposing latitudinal sidewalls of the tray, and, wherein the tray includes a wall extending from a top latitudinal peripheral position to a bottom latitudinal peripheral edge forming a longitudinal front wall adjoined to the latitudinal sidewalls.

Typically in such an embodiment the generally flat lip is disposed along the bottom peripheral longitudinal edge with a recess formed in said sidewalls above said generally flat lip.

In such an embodiment, the bottom end typically has another generally flat lip disposed along a bottom latitudinal peripheral edge of the pad, projecting in a longitudinal direction away from the cells and having an undersurface disposed generally in the generally common plane.

BRIEF DESCRIPTION OF THE DRAWINGS

The drawings depict various embodiments of the invention wherein.

DETAILED DESCRIPTION

Figure 1:
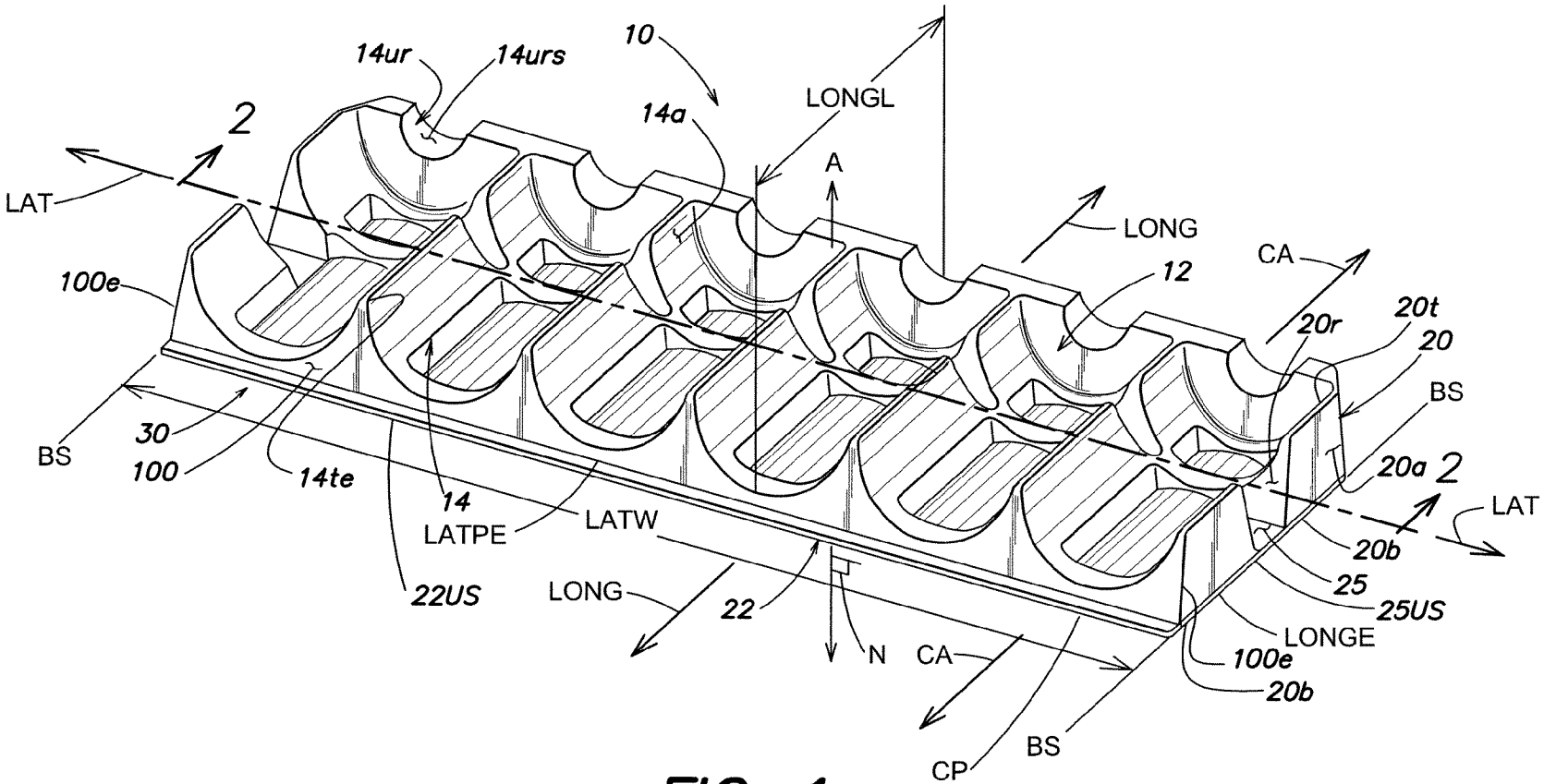
FIG. 1 is a top right perspective view of a 6 cell mounting pad according to one embodiment of the invention showing the longitudinal side of pad having a solid wall.

FIG. 1 shows in perspective view a mounting pad 10 according to one embodiment of the invention. The pads 10 are typically integrally molded from a sheet of polystyrene foam which is formed into an end product having the components and structure described herein via conventional molding processes, e.g., pressing a foam sheet between male and female dies to form a plurality of pads with shaped portions and then removing (trimming) any remaining portions of the sheet to form each integral pad structure 10.

The pad 10, FIG. 1, has a latitudinal width LATW extending between left and right side bottom longitudinal peripheral edges LONGE. The pad 10 has an open top end 12 through which a series of six successive open recesses or cells 14 can be readily accessed for insertion of a complementarily shaped end **16*e*1, 16*e*2 of a light bulb 16, FIGS. 8, 10. Each cell 14 comprises a recess that is formed into the body of a sheet of polystyrene material by the forming process such that the recess or cell 14 has walls 14*a* that are complementary in shape and contour to and can mate complementarily with the contour of the outside surface 16*s* of an end 16*e* of a light bulb 16 having a known or predetermined outside surface contour 16*s*, FIGS. 7, 8, 10**.

Figure 10:
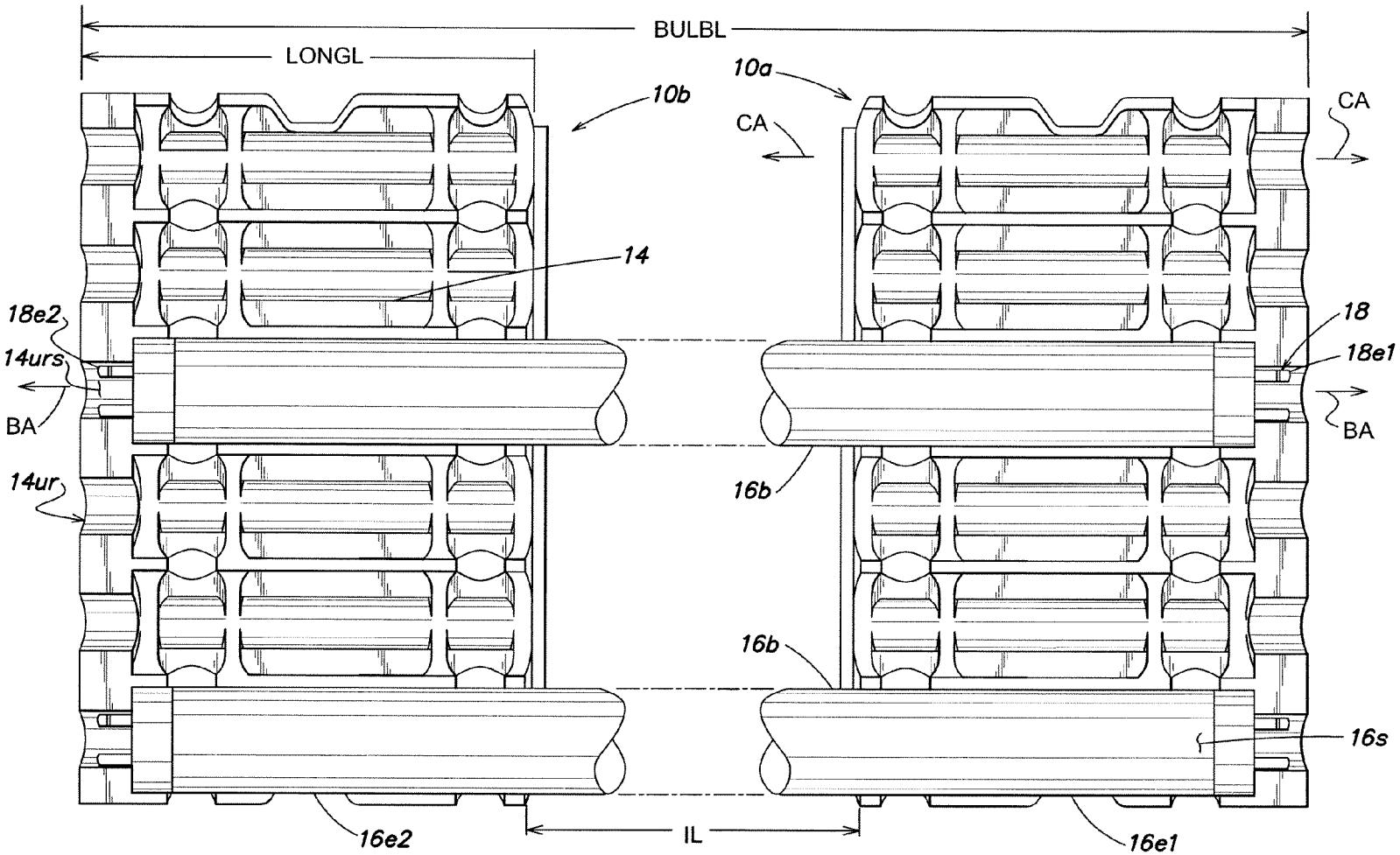
FIG. 10 is a top view similar to FIG. 8 showing both terminal ends of the light bulbs separately mounted in opposing separate mounting pads according to the invention; and, FIG. 11 is a side perspective view of an automated machine that separates and deposits mounting pads on a conveyor.

Thus an end **16*e* of a suitable light bulb 16 can be inserted and received within a cell 14 and engageably mated with a cell receiving surface 14*a* in a generally snug or geometrically matching fit manner such that the end 16*e* of the bulb 16 is cushion mounted on a polystyrene foam component 10 which itself provides a cushion resistance to shock that may be applied to the body of the mounting pad 10. As shown in FIGS. 1, 7, 8, 10, a light bulb 16 is mounted in a pair of pads 10 at opposing terminal ends 16*e*1, 16*e*2 of the bulb 16. The bulbs 16 have a longitudinal axis BA, FIGS. 8, 10 and the cells 14 have a complementary longitudinal cell axis CA, FIGS. 1, 10 that the axes BA of the bulbs are aligned with when the bulbs 16 are inserted within the cells 14. As shown in FIG. 10 the cells 14 and/or the pads 10 have a longitudinal length LONGL that is less than half the overall longitudinal length BULBL of the bulbs that extends between the terminal ends 18*e*1 and 18*e*2 of an opposing pair of electrically conductive, typically metal, prongs 18 disposed on the opposing terminal ends 16*e*1, 16*e*2 of the bulbs 16*e*. Thus a matching, typically mirror image pair of mounting pads 10*a*, 10*b* are mounted on the opposing ends 16*e*1, 16*e*2 of a bulb 16 leaving a certain intermediate length IL, FIG. 10 of a bulb 16 that is not mounted or engaged within a cell 14 of a pad 10 because the longitudinal length BULBL of the bulb 16 is greater than the sum of the longitudinal lengths LONGL of the pair of mounting pads 10*a*, 10*b*. Typically the longitudinal lengths LONGL of the pads 10 or their cells 14 are less than about 50% of the longitudinal length BULBL of the bulbs 16**. Two pads collectively may extend about 8% to about 50% of the bulb length, or collectively extend about 15% to about 40% of the bulb length.

As shown in FIGS. 1-3, 5-6, the pad 10 has downwardly projecting ridges DPR projecting downwardly toward its bottom end 30, the ridges having bottomwardly facing undersurfaces US that generally lie within a common plane CP and collectively define a bottom end surface BS of the tray and the pad generally. The bottom surface BS and generally planar common plane CP are disposed generally normal N, FIGS. 1, 3, to the top to bottom axis A of the pad 10.

Figure 4:
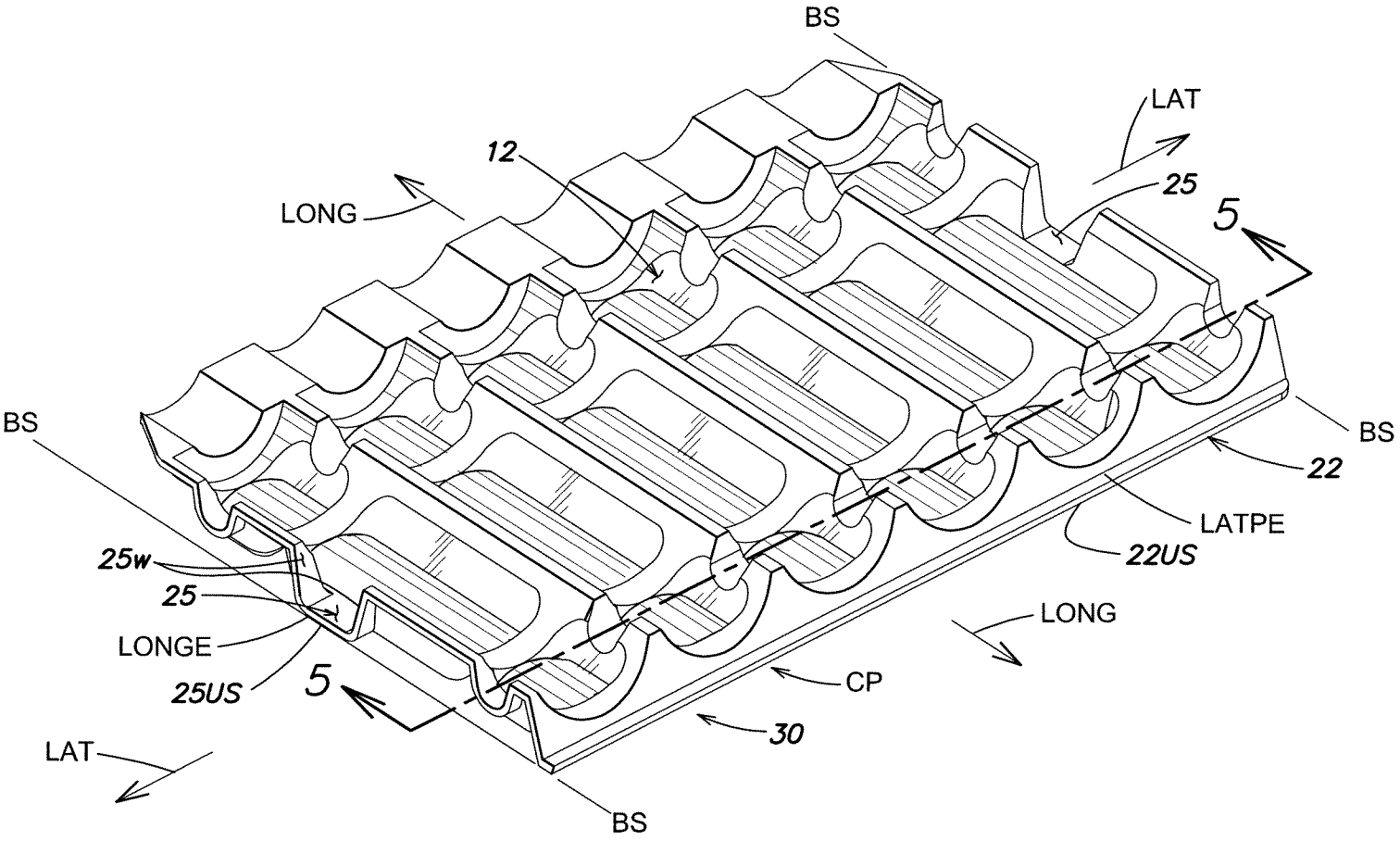
FIG. 4 is a top left side perspective view of another embodiment of mounting pad according to the invention showing the longitudinal sides of the device being open without side walls.

A typically flat flange or flange-like lip 22 extends in a longitudinal direction LONG away from the bottom peripheral lateral edge LATPE, FIGS. 1, 4. The lip 22 has a typically generally flat undersurface 22US that lies generally within the generally common plane CP to further define the bottom surface BS. As shown, the lip 22 is disposed and extends along at least a portion of and typically the entire lateral width LATW of the bottom lateral peripheral edge of the pad 10 and its associated tray. The undersurface 22US of the longitudinally extending lip 22 can be readily manually engaged to denest or separate pads 10 that are stacked on top of each other when filled with light bulbs or otherwise stacked and nested one on top of each other without bulbs.

A front latitudinal wall 100 is formed and extends from a top longitudinal peripheral point **10*te* downwardly to the bottom lateral peripheral edge LATPE across the entire latitudinal width LATW of the tray. In the FIGS. 1-3 embodiment, the front wall is adjoined at its opposing latitudinal edges 100*e* with sidewalls 20 forming a tray having three enclosed or walled sides 20, 100. In the FIGS. 4-6 embodiment, opposing sidewalls 20 do not exist, the front wall 100 being the only walled side of the tray 14**.

Another flange or flange like lip or flat surface 25 having a generally flat undersurface 25US is disposed and extends along at least a portion of the bottom longitudinal peripheral edge LONGE, FIGS. 1, 4 of the pad 10. As with the undersurface 22US, the undersurface 25US is disposed generally in the common plane CP to further define the bottom surface BS of the device 10. As shown the lip 25 extends in a latitudinal direction LAT away from the cells toward and terminating at the bottom longitudinal edge LONGE forming a tab or projection or lip 25 that can be manually engaged on the undersurface 25US to denest or separate pads 10 that are stacked on top of each other when filled with light bulbs or when otherwise nested one on top of and within each other without bulbs.

Figure 2:
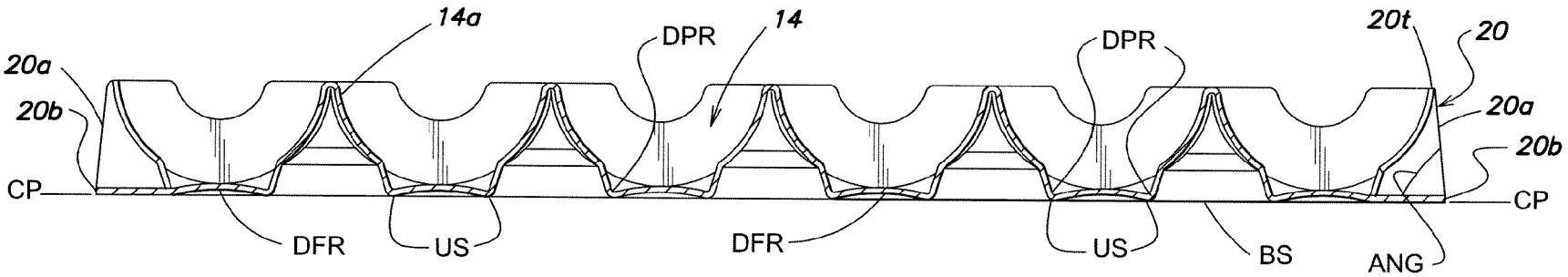
FIG. 2 is a sectional view of the FIG. 1 pad along lines 2-2.
Figure 3:
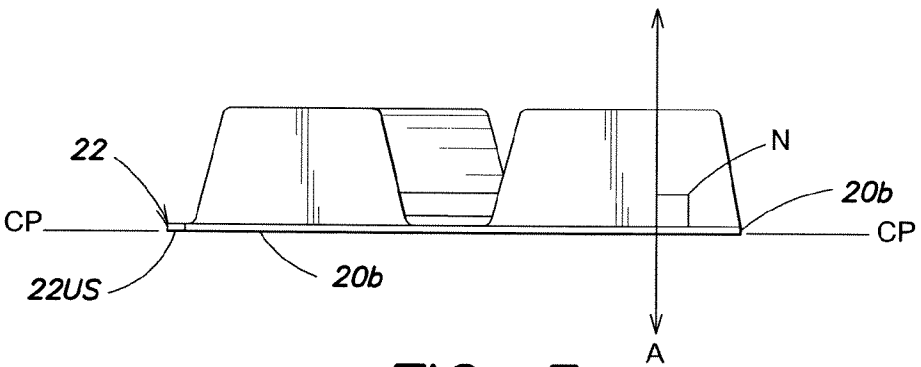
FIG. 3 is a right longitudinal side view of the FIG. 1 pad.

In the FIGS. 1-3 embodiment, the longitudinal sides 20 of the pads 10 have a sidewall **20*a* that extends from a top peripheral longitudinal edge 20*t* downwardly to a bottom peripheral longitudinal edge LONGE as well as in the longitudinal direction LONG except for a laterally or latitudinally extending LAT recess 25*r* at the bottom of which is disposed the lip or flat member 25. The side wall portion 20*a* is disposed at a slight angle ANG other than 90 degrees relative to the common plane CP while a bottom-most edge surface 20*b*** extends vertically upward from the common plane CP at generally 90 degrees by a distance that is about equal to the thickness of the plastic material.

Figure 5:
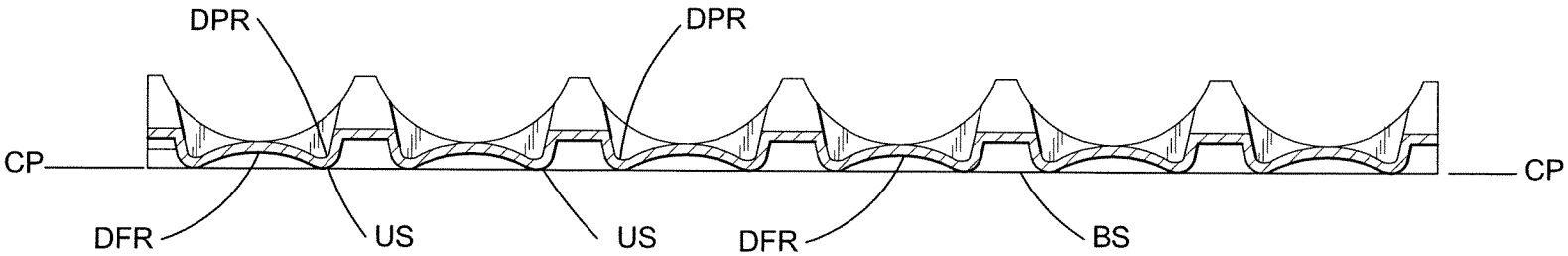
FIG. 5 is a sectional view of the FIG. 4 pad taken along lines 5-5 of FIG. 4.
Figure 6:
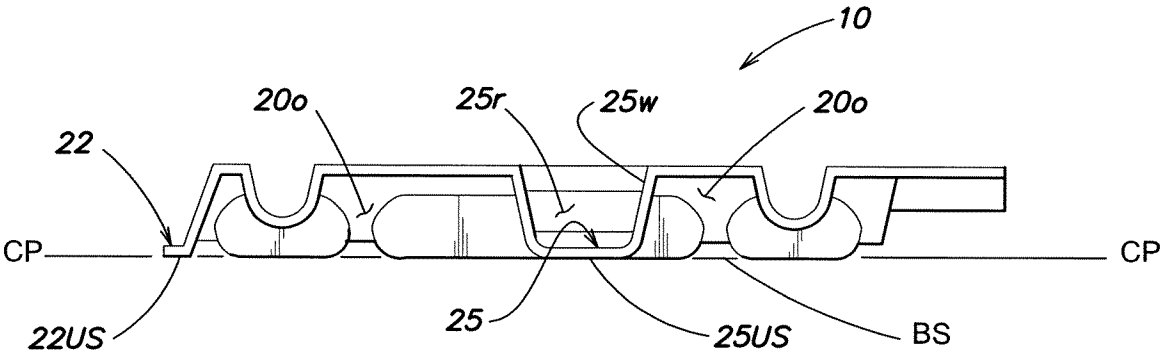
FIG. 6 is right longitudinal side view of the FIG. 4 pad.

In the FIGS. 4-6 embodiment the longitudinal sides 20 do not have a sidewall 20 as in the FIGS. 1-3 embodiment. The FIGS. 4-6 embodiment include the same laterally or latitudinally extending lip or flat member 25 having undersurface 25US and recess 25*r* which is formed by opposing walls 25*w* that face each other in the longitudinal direction LONG and extend in the lateral direction LAT.

Figure 7:
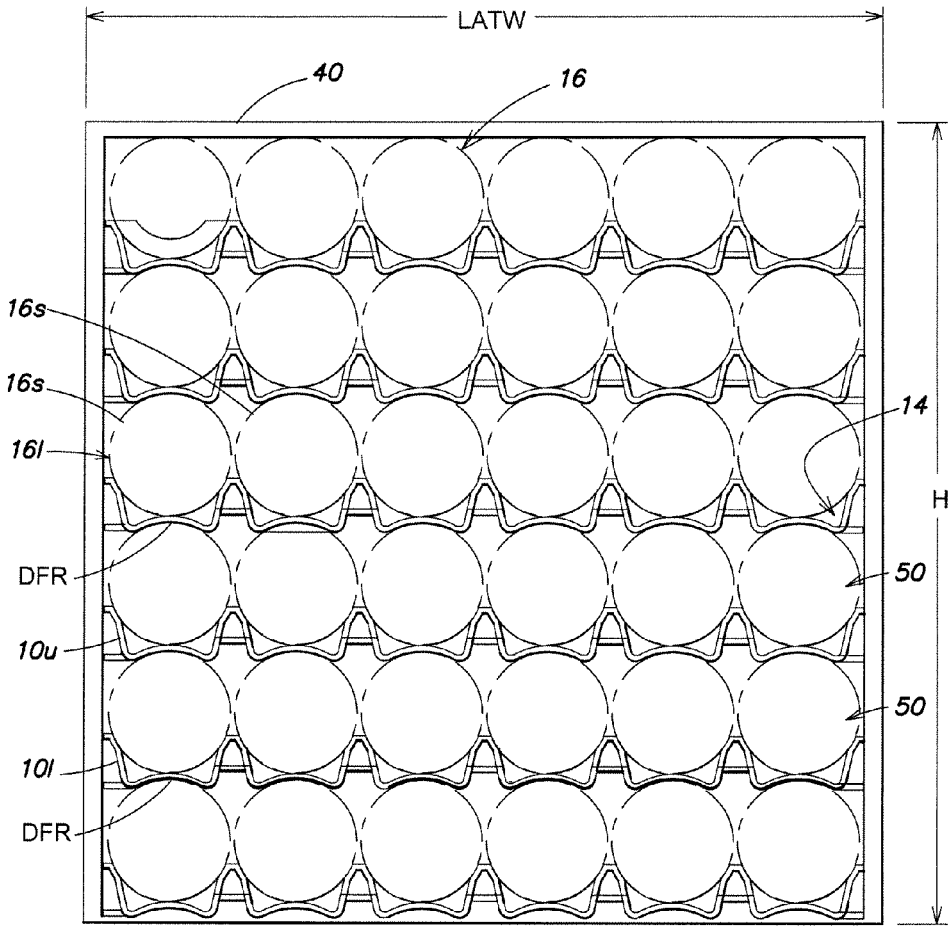
FIG. 7 is an end view of a carton or box according to the invention filled with six rows of light bulbs, each row mounted in a pair of mounting pads and the rows stacked one on top of each other to provide a 6×6 bulb array within the interior of the carton or box in a manner and using mounting pads according to the invention.
Figure 8:
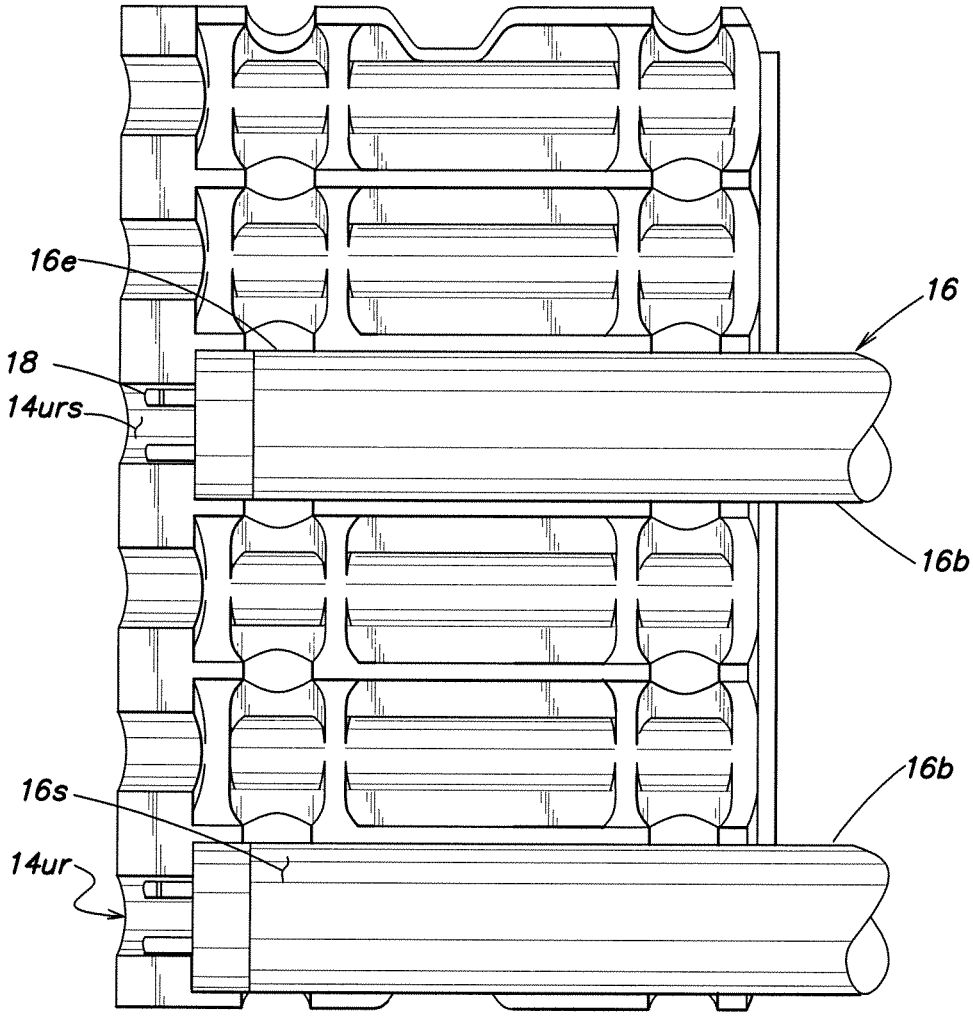
FIG. 8 is a top view of one terminal end of two light bulbs mounted in a mounting pad according to the invention.

As shown in FIGS. 2, 5, 7 the bottom end 30 of the pad 10 has downwardly facing recesses DFR formed between undersurfaces US (feet) on the bottom surfaces of the cells and are aligned with the longitudinal cell axes CA of the cells. The downwardly facing recesses are complementary in contour to the outer surfaces and arrangement of the bulbs 16*l* when inserted within a first pair 10*l* of pads such that when one pair of pads 10*u* is stacked on top of another pair of pads 10*l* that are filled with bulbs 16*l* the upper-side surfaces 16*s* of the bulbs 161 are received within the downwardly facing recesses DFR formed on the bottoms of the cells 14 of the pads.

One longitudinal end of the cells 14 is typically provided with an upper terminal end recess 14*ur* having a wall surface 14*urs* that is formed and arranged for receiving and supporting the prongs 18 that typically project from the terminal ends of a bulb 16.

Figure 9:
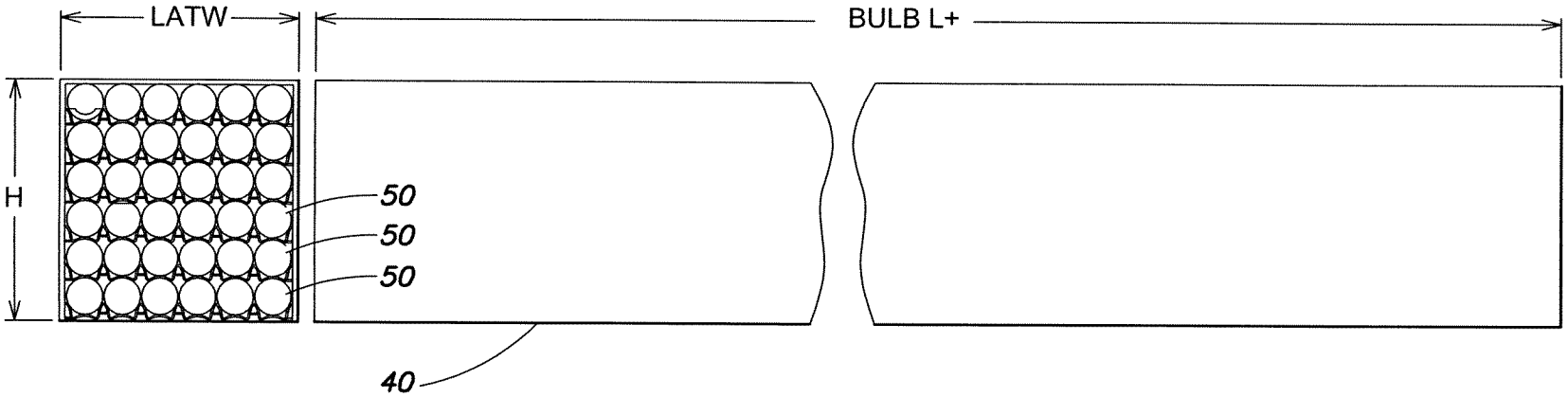
FIG. 9 is a combined end and side longitudinal view of a carton or box according to the invention filled with successively stacked pairs of mounting pads with inserted light bulbs according to the invention.

As shown in FIGS. 7, 9, when one pair of filled pads 10 is stacked on top of anther pair of filled pads, the stack can be inserted into a reversibly enclosable box 40 that generally has a length about equal to or slightly larger than the longitudinal length of the bulbs BULBL and a width about equal to or slightly larger than the latitudinal width LATW of the pads 10. The box has a height H that is selected to snugly enclose a preselected number of rows 50 of bulbs 16 stacked one on top of each other as described above where the terminal ends 16*e* of the bulbs 16 are mounted within the cells 14, 14*ur* of a pair of pads 10 disposed at opposing ends 16*e*1, 16*e*2 of the bulbs.

Figure 11:
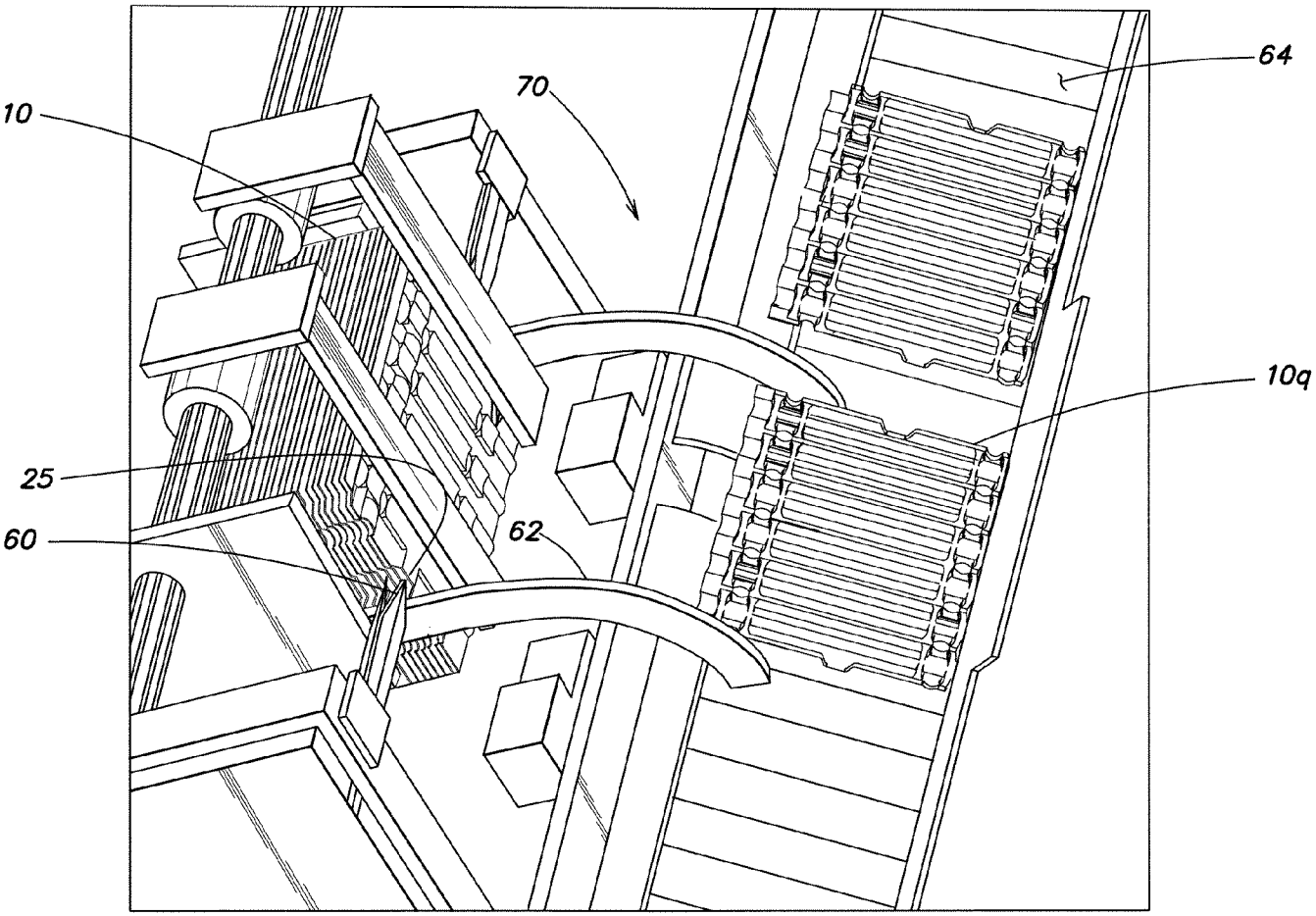

FIG. 11 illustrates an embodiment of an apparatus 70 for automated handling of the pads 10. A metal picker finger 60 is shown being inserted between a pair of adjacent denesting flanges 25 on two adjacent pads in the stack of pads being held between the curved arms 62 of the apparatus 70. Subsequent to their separation the end pad 10*q* is rotated 90 degrees along the curved pair of arms and deposited onto the moving conveyor belt 64. The pads are moved along the conveyor to the next station where the bulbs 16 can be inserted into the cells 14 of a pair of pads 10.

The second embodiment of FIGS. 4-6 is configured to hold six, 1 inch diameter, 48 inch long fluorescent light bulbs, one in each of the six cells. Each pad is about 4 inches in length (LONG direction), 6⅝ inches in width (LAT direction), and about ⅜ inches in height (AA direction). Use of two such pads, one on each end of the bulbs, when stacked in a box as shown in FIG. 9, 6 bulbs across (LATW) and 6 bulbs high (H), provides an appropriate 70% weight reduction from a prior art pulp 5-pack tray pad and box, and an approximate 25-30% reduction in stack height.

In one example, the sheet is made of a polystyrene material that is extruded as a continuous sheet, e.g., 24.5 inches wide. The sheet is then aged about three days before being run through a thermo forming oven tunnel, where it expands to double (180 to 200 percent) its extruded thickness. The sheet is then shaped (formed) between two mold halves, and sent to the next station where the pads are trimmed and pushed onto a table and then packaged or bundled. For example, a 24½ wide sheet may form 30 parts at a time, and then trim to five pads. For an extruded sheet thickness at 0.045 inch target, the sheet density is about 9.07 pounds per cubic foot. A suitable range may be 6 to 12 pounds per cubic foot. For a polystyrene foamed sheet weight of 34 pounds per 1000 square feet, or one square inch equals 0.010710 grams per square inch.

It is to be understood that the foregoing description is intended to illustrate and not limit the scope of the invention.

The invention claimed is:

1. A mounting pad for receiving a plurality of elongated cylindrical light bulbs each having a preselected longitudinal bulb length, a longitudinal axis and a latitudinal bulb diameter, the mounting pad comprising:

a tray comprised of a foamed polymer material, the tray comprising a plurality of bulb mounting cells formed in an open top end of the tray, the cells having a longitude of selected cell length and a latitude of selected cell width, each cell adapted to receive a bulb with the bulb diameter extending across the selected width of a cell and with the longitudinal axis of the bulb aligned with the longitude of a cell;

the tray having a bottom end and a top to bottom axis generally normal to a bottom surface defined by a plurality of feet each having an undersurface extending downwardly to an axially bottom-most position lying in a generally common plane on the bottom end to define the bottom surface of the tray;

the bottom end having a generally flat lip disposed along a bottom latitudinal peripheral edge of the tray at about normal to the top to bottom axis, the flat lip projecting in a longitudinal direction away from the cells and having an undersurface disposed in the generally common plane; the bottom end having another generally flat lip disposed along a bottom longitudinal peripheral edge of the tray, extending in a latitudinal direction away from the cells and having an undersurface disposed in the generally common plane; and the bottom end of the tray is formed into a plurality of bottom facing recesses aligned with the longitude and latitudinal width of the cells formed in the open top end, the bottom facing recesses being arranged to be stacked on top of, receive and being complimentary contoured to mate with upper surfaces of the latitudinal bulb diameter of a plurality of bulbs that are mounted within the cells formed in the open top end of another tray.

2. The mounting pad of claim 1 wherein the bottom end and the open top end have complementary male and female configurations respectively adapted to enable the bottom end of one tray to be stacked on top of, received and nested within the open top end of another tray.

3. The mounting pad of claim 1 wherein the tray includes walls extending from a top peripheral longitudinal edge to a bottom peripheral longitudinal edge of the tray forming opposing latitudinal sidewalls of the tray, the another generally flat lip being disposed along the bottom peripheral longitudinal edge with a recess formed in said sidewalls above said another generally flat lip.

4. The mounting pad of claim 1, in combination with light bulbs received in the cells, the bulbs having a bulb length and wherein the selected cell length is less than 50% of the bulb length.

5. A pair of the mounting pads of claim 1, in combination with light bulbs received in the cells, the bulbs having a bulb length and wherein the combined cell length is about 8 to about 50% of the bulb length.

6. The mounting pad of claim 1 wherein the tray comprises any of 2 to 10 cells.

7. The mounting pad of claim 6 wherein the tray comprises 5 or 6 cells.

8. The mounting pad of claim 1 wherein the tray is a unitary sheet of the foamed polystyrene.

9. The mounting pad of claim 8 wherein the thickness of the tray is less than about 1.5 mm.

10. The mounting pad of claim 3 wherein the feet are formed by a plurality of downwardly projecting ridges that form the bottom facing recesses, the ridges having downwardly facing peak surfaces that lie generally within the generally common plane.

11. A mounting pad for receiving a plurality of elongated cylindrical light bulbs each having a preselected longitudinal bulb length, a longitudinal axis and a latitudinal bulb diameter, the mounting pad comprising:

a tray comprised of foamed polymer material, the tray comprising a plurality of bulb mounting cells formed in an open top end of the tray, the cells having a longitude of selected cell length and a latitude of selected cell width, each cell adapted to receive a bulb with the bulb diameter extending across the selected width of a cell and with the longitudinal axis of the bulb aligned with the longitude of a cell;

the tray having a bottom end and a top to bottom axis generally normal to a bottom surface defined by a plurality of feet each having an undersurface extending downwardly to an axially bottom-most position lying in a generally common plane on the bottom end to define the bottom surface of the tray;

the bottom end having a generally flat lip disposed along a bottom longitudinal peripheral edge of the tray, extending in a latitudinal direction away from the cells and having an undersurface disposed in the generally common plane;

the bottom end of the tray is formed into a plurality of bottom facing recesses aligned with the longitude and latitudinal width of the cells formed in the open top end, the bottom facing recesses being arranged to be stacked on top of, receive and being complimentary contoured to mate with upper surfaces of the latitudinal bulb diameter of a plurality of bulbs that are mounted within the cells formed in the open top end of another tray; and the open top end of the tray having a latitudinal end wall engaging the end surface of each bulb and an upper terminal recess for receiving prongs on the end surface of each bulb.

12. The mounting pad of claim 11 wherein the tray includes walls extending from a top peripheral longitudinal edge to a bottom peripheral longitudinal edge of the tray forming opposing latitudinal sidewalls of the tray, the generally flat lip being disposed along the bottom peripheral longitudinal edge with a recess formed in said sidewalls above said generally flat lip.

13. The mounting pad of claim 11 wherein the bottom end has another generally flat lip disposed along a bottom latitudinal peripheral edge of the tray and projecting in a longitudinal direction away from the cells and having an undersurface disposed in the generally common plane.

14. The pad of claim 13 including a wall extending from a top latitudinal peripheral position to a bottom latitudinal peripheral edge forming a longitudinal front wall adjoined to the latitudinal sidewalls.

15. A plurality of stacked elongated cylindrical light bulbs mounted in a spaced arrangement snugly fit within an enclosable box having a selected height, the box containing a plurality of the mounting pads of claim 1 having a plurality of the light bulbs mounted within the cells of the trays of the pads, the plurality of pads with bulbs mounted in the trays of the pads being stacked one on top of each other in a number of rows sufficient to extend through and occupy the entire selected height of the box, the box having a length about equal to the bulb length, the box having a width about equal to the latitudinal width of the mounting pads.

16. A plurality of stacked elongated cylindrical light bulbs mounted in a spaced arrangement snugly fit within an enclosable box having a selected height, the box containing a plurality of the mounting pads of claim 11 having a plurality of the light bulbs mounted within the cells of the trays of the pads, the plurality of pads with bulbs mounted in the trays of the pads being stacked one on top of each other in a number or rows sufficient to extend through and occupy the entire selected height of the box, the box having a length about equal to the bulb length, the box having a width about equal to the latitudinal width of the mounting pads.

17. A method of stacking light bulbs one on top of the other, each light bulb having a preselected longitudinal bulb length, a longitudinal axis and a latitudinal bulb diameter, the method comprising:

providing a mounting pad in accordance with claim 1, inserting opposite ends of a plurality of said light bulbs into the cells of the open top ends of the trays of corresponding pairs of said mounting pads such that the longitudinal lengths of the bulbs are aligned with the longitude of the cells of the trays of the pads, stacking one pair of mounting pads having light bulbs inserted in the cells of the trays on top of another pair of mounting pads having light bulbs inserted in the cells of the trays of the other pair of mounting pads;

wherein the light bulbs inserted in the cells of the other pair are aligned with and received within the bottom facing recesses of the one pair of mounting pads stacked on top of the other pair, and, wherein the longitudinal bulb lengths of the bulbs inserted within the one pair are aligned with the longitudinal bulb lengths of the other pair.

18. The method of claim 17 further comprising:

providing an enclosable box having a selected height, a width complementary to the latitudinal width of the mounting pads and a length complementary to the longitudinal bulb length of the bulbs together with any longitudinal length added to the bulb lengths when the bulbs are mounted in the cells of the trays of the pads, inserting opposite longitudinal ends of a plurality of said light bulbs into the cells of the open top ends of the trays of successive pairs of said mounting pads and stacking said successive pairs of mounting pads on top of each other to a height complementary to the selected height of the box, and, fully inserting the successively stacked mounting pads with bulbs inserted in the cell of the tray into the box such that the box fully encloses the inserted mounting pads and light bulbs.

19. A mounting pad for receiving a plurality of elongated cylindrical light bulbs each having a preselected longitudinal bulb length, a longitudinal axis and a latitudinal bulb diameter, the mounting pad comprising:

a tray comprised of foamed polymer material, the tray comprising a plurality of bulb mounting cells formed in an open top end of the tray, the cells having a longitude of selected cell length and a latitude of selected cell width, each cell adapted to receive a bulb with the bulb diameter extending across the selected width of a cell and with the longitudinal axis of the bulb aligned with the longitude of a cell;

the tray having a bottom end and a top to bottom axis generally normal to a bottom surface defined by a plurality of feet each having an undersurface extending downwardly to an axially bottom-most position lying in a generally common plane on the bottom end to define the bottom surface of the tray;

the bottom end having a generally flat lip disposed along a bottom longitudinal peripheral edge of the pad, extending in a latitudinal direction away from the cells and having an undersurface disposed gcncrally in the generally common plane, wherein the tray includes walls extending from a top peripheral longitudinal edge to a bottom peripheral longitudinal edge of the tray at opposing latitudinal sides of the tray forming opposing latitudinal sidewalls of the tray, wherein the tray includes a wall extending from a top latitudinal peripheral position to a bottom latitudinal peripheral edge forming a longitudinal front wall adjoined to the latitudinal sidewalls;

the bottom end of the tray is formed into a plurality of bottom facing recesses aligned with the longitude and latitudinal width of the cells formed in the open top end, the bottom facing recesses being arranged to be stacked on top of, receive and being complimentary contoured to mate with upper surfaces of the latitudinal bulb diameter of a plurality of bulbs that are mounted within the cells formed in the open top end of another tray; and the open top end of the tray having a latitudinal end wall engaging the end surface of each bulb and an upper terminal recess for receiving prongs on the end surface of each bulb.

20. The pad of claim 19 wherein the generally flat lip is disposed along the bottom peripheral longitudinal edge with a recess formed in said sidewalls above said generally flat lip.

21. The pad of claim 19 wherein the bottom end has another generally flat lip disposed along a bottom latitudinal peripheral edge of the tray and projecting in a longitudinal direction away from the cells and having an undersurface disposed in the generally common plane.

* * * * *